US005672206A

United States Patent [19]

Gorman

[11] Patent Number: 5,672,206

[45] Date of Patent: Sep. 30, 1997

[54] MOISTENING DISPENSER FOR A ROLL OF PAPER SHEETS

[76] Inventor: Tom Gorman, 320 Bayview Ave., E. Patchogue, N.Y. 11772

[21] Appl. No.: 541,105

[22] Filed: Oct. 11, 1995

[51] Int. Cl.[6] ..... B05C 5/00

[52] U.S. Cl. ..... 118/320; 118/313; 118/315; 118/325

[58] Field of Search ..... 118/325, 320, 118/315, 313

[56] References Cited

U.S. PATENT DOCUMENTS 3,151,822 10/1964 Glaner ..... 118/325
3,317,150 5/1967 Summersby .
3,995,582 12/1976 Douglas .
4,598,664 7/1986 Hamlin ..... 118/325
5,135,179 8/1992 Morano .
5,311,986 5/1994 Putz .

*Primary Examiner*—Donald E. Czaja
*Assistant Examiner*—Steven B. Leavitt
*Attorney, Agent, or Firm*—Michael I. Kroll

[57] ABSTRACT

A moistening dispenser (10) for a roll of paper sheets (12) having a hollow core (14). The dispenser (10) comprises a holder (16) to be attached to a wall (18). The holder (16) will retain the hollow core (14) of the roll of paper sheets (12) in a rotatable manner. A structure (20) is built into the holder (16), for applying a predetermined amount of liquid (22) directly onto a first paper sheet (24) on the roll (12), just before the first paper sheet (24) is to be removed from the roll (12).

9 Claims, 5 Drawing Sheets

46
48
44
42
54
58
52
20
32
22
62
40
60

46
20
40
60
44
12
32
14
24

72
70
20
68
66
73
38
14
78
28
62
60
1e
10
34
64
16
26
54
52
40
42
48
12
76
58
46
44
32
36
74
30a
28

34
10
66
20
12
68
80
14
16
40
60
86
22
84
62
28
88
82
32
30b
38
78

30a
46
44
50
56
20
40
10
74
76
32
16
22
28
48
42
58
52
36
1d

MOISTENING DISPENSER FOR A ROLL OF PAPER SHEETS

BACKGROUND OF THE INVENTION

1. Field of the Invention

The instant invention relates generally to dispensing devices and more specifically it relates to a moistening dispenser for a roll of paper sheets.

2. Description of the Prior Art

Numerous dispensing devices have been provided in prior art. For example, U.S. Pat. No. 3,317,150 to Summersby; U.S. Pat. No. 3,995,582 to Douglas; U.S. Pat. No. 5,135,179 to Morano and U.S. Pat. No. 5,311,986 to Putz all are illustrative of such prior art. While these units may be suitable for the particular purpose to which they address, they would not be as suitable for the purposes of the present invention as heretofore described.

SUMMERSBY, ERNEST JOHN

SELF-POWERED DISPENSER

U.S. Pat. No. 3,317,150

In a preferred embodiment of this invention, a drive motor, and a power supply therefore in the form of one or more batteries, are concealed within a roller, about which a roll of material to be dispensed is disposed. The drive motor is selectively energized by the user to initiate rotation of the roller and, thus, of the roll of material. The material is therefore progressively unrolled from the roll. The motor is selectively deenergized by the user to terminate the unrolling of the material, after any desired length, for severance of the material from the roll. A means is provided for preventing dispensing rotation of the roller during such material severance. Alternatively, if desired, the motor can be automatically shut off after a predetermined time interval has passed.

DOUGLAS, LIVINGSTON C.

MOIST TISSUE DISPENSING

U.S. Pat. No. 3,995,582

A dispensing package comprises a toroidal container body enclosing a coreless rolled web of moisture absorbent material having free rotation about the axis of the body on body side wall areas of reduced diameter at opposite ends of a liquid reservoir. The leading end of the web is drawn through a longitudinal slot in a body side wall extending the full width of the web and through upper and lower flange lips defining with the slot a dispensing passage.

MORANO, MICHAEL

PAPER TOWEL DISPENSER WITH BRAKE

U.S. Pat. No. 5,135,179

A dispenser for dispensing a paper sheet from a paper roll having a core. The dispenser can have a spindle made of two separate sleeves. The sleeves are inserted in opposite ends of the core and frictionally retained therein. A support is rotatably mounted in one sleeve to support the roll. A brake member is rotatably mounted in the other sleeve and selectively cooperates therewith to brake rotation of the roll on the support.

PUTZ, JOAN M.

PREMOISTENED WIPE DISPENSER FOR CONVENTIONAL TOILET-TISSUE ROLL HOLDERS

U.S. Pat. No. 5,311,986

A dispensing device for providing premoistened wipes from the conventional toilet-tissue roll holder, so that dry and moist cleaning material is available from the same convenient location. The dispensing device comprising an upper container section with sidewalls and back wall extending underneath the container section. Lid exit is provided in an end wall of the container section, for removal of premoistened wipes. Sufficient space provided underneath the container section is for placement of a toilet-tissue roll between the lower sidewalls and back wall. Mounting holes provided in lower sidewalls are for mounting the dispenser on the roll holder spindle. The dispensing device conveniently provides premoistened wipes in the space above the toilet-tissue roll.

SUMMARY OF THE INVENTION

A primary object of the present invention is to provide a moistening dispenser for a roll of paper sheets that will overcome the shortcomings of the prior art devices.

Another object is to provide a moistening dispenser for a roll of paper sheets that is built into the holder for the roll of paper sheets, so that the moistening dispenser can apply a predetermined amount of liquid directly onto a paper sheet just before removal from the roll.

An additional object is to provide a moistening dispenser for a roll of paper sheets that will spray the liquid onto the paper sheet by rotation of the roll, when the paper sheet is being pulled off the roll.

A further object is to provide a moistening dispenser for a roll of paper sheets that is simple and easy to use.

A still further object is to provide a moistening dispenser for a roll of paper sheets that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view, showing a first embodiment of the instant invention built into a toilet tissue roll holder mounted into a bathroom wall.

FIG. 1*a* is a perspective view with parts broken away, showing the canister pump being filled with a liquid.

FIG. 1*b* is a perspective view, showing the canister pump being inserted into a hollow core of a roll of paper sheets.

FIG. 1*c* is a front perspective view taken in the direction of arrow 1*c* in FIG. 1, with parts broken away.

FIG. 1*d* is a front elevational view of the left side taken in the direction of arrow 1*d* in FIG. 1*c*, with parts broken away.

FIG. 1*e* is a front elevational view of the right side taken in the direction of arrow 1*e* in FIG. 1*c*, with parts broken away and in section.

Similar reference characters denote corresponding features consistently throughout the attached drawings.

DETAILED DESCRIPTION OF THE PREFERRED EMBODIMENTS

Figure 1:
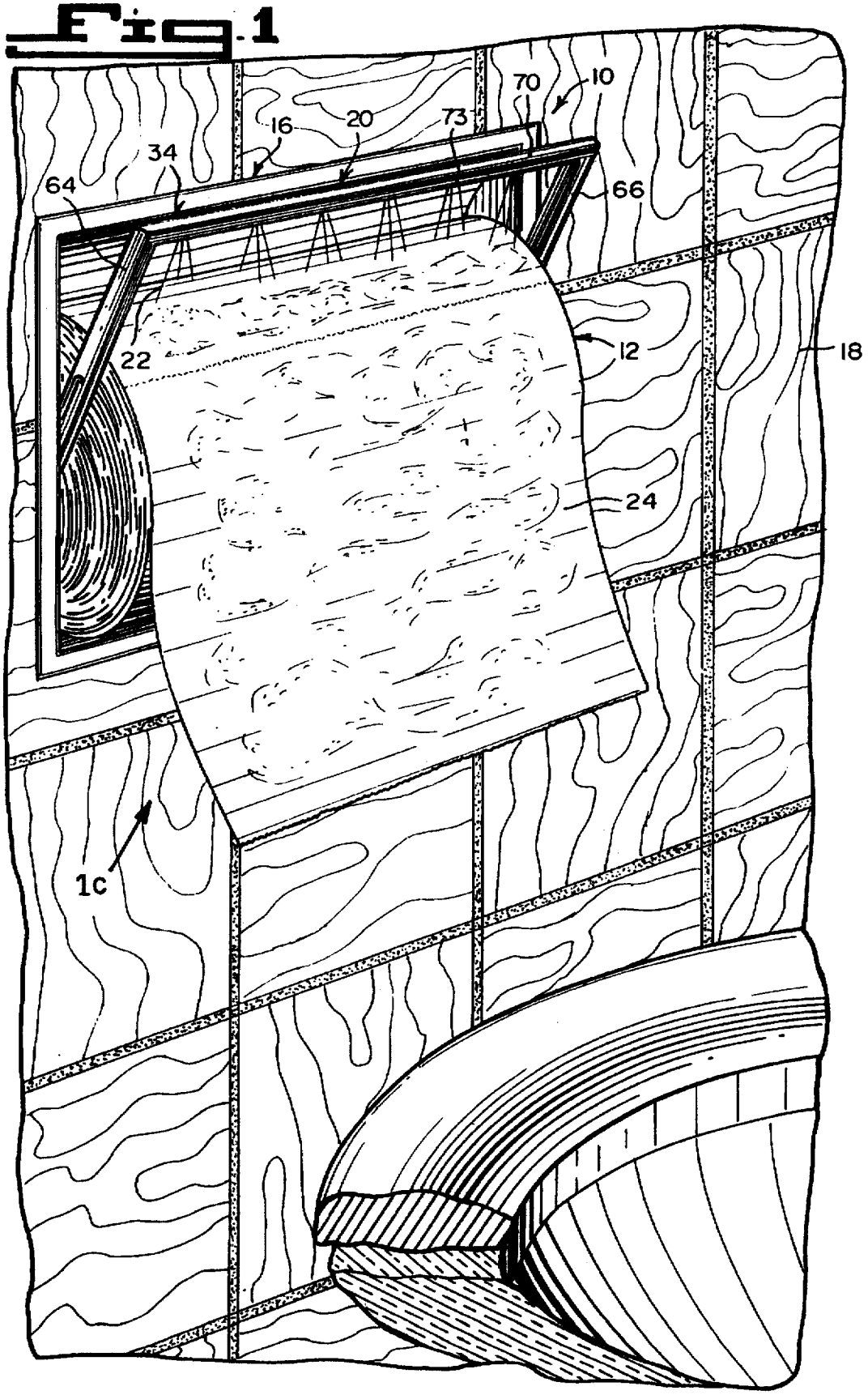

Turning now descriptively to the drawings, in which similar reference characters denote similar elements throughout the several views, FIGS. 1 through 9 illustrate a moistening dispenser 10 for a roll of paper sheets 12, having a hollow core 14. The dispenser 10 comprises a holder 16 to be attached to a wall 18. The holder 16 will retain the hollow core 14 of the roll of paper sheets 12 in a rotatable manner. A structure 20 is built into the holder 16, for applying a predetermined amount of liquid 22 directly onto a first paper sheet 24 on the roll 12, just before the first paper sheet 24 is to be removed from the roll 12.

The holder 16 includes a base member 26 that is attached to the wall 18. A pair of legs 28 are provided, in which each leg 28 projects outwards at a right angle from one end of the base member 26. A pair of stub shafts 30*a* and 30*b* are also provided. Each stub shaft 30*a* and 30*b* projects sidewards at a right angle from one side of one leg 28 and is parallel to the base member 26. The stub shafts 30*a* and 30*b* face one another to engage with opposite ends of the hollow core 14 of the roll of paper sheets 12.

The liquid applying structure 20, as shown in FIGS. 1 to 4, consists of a canister pump 32 for holding the liquid 22, that is insertable into the hollow core 14 of the roll of paper sheets 12. A generally U-shaped spray arm 34 is pivotally mounted in an inverted manner onto the stub shafts 30*a* and 30*b*. A facility 36 at a first end of the spray arm 34 is for operating the canister pump 32, when the spray arm 34 is pulled down. An assembly 38 at a second end of the spray arm 34 is for fluidly connecting the spray arm 34 to the canister pump 32. The predetermined amount of liquid 22 from the canister pump 32 can go into the spray arm 34 and then be discharged from the spray arm 34 onto the first paper sheet 24 n the roll 12.

The canister pump 32 contains a sealed cylindrical housing 40 sized to fit snugly into the hollow core 14 of the roll of paper sheets 12. A hollow threaded shaft 42 has a first end extending outward from a first side 44 of the cylindrical housing 40. A second end extends into the cylindrical housing 40, so that the liquid 22 can be filled into the cylindrical housing 40. A cap 46 having a slot 48, threads onto the first end of the hollow threaded shaft 42. A longitudinal track 50 is on an interior surface of the cylindrical housing 40. A disk plate 52 having an internally threaded central hole 54, threads onto the hollow threaded shaft 42 within the cylindrical housing 40. A follower 56 on the disk plate 52, rides within the longitudinal track 50. A spring 58 is within the cylindrical housing 40 between the first side 44 of the cylindrical housing 40 and the disk plate 52, so as to bias the disk plate 52 towards a second side 60 of the cylindrical housing 40 that is holding the liquid 22 therein. A ball check valve 62 is on the second side 60 of the cylindrical housing 40.

The spray arm 34 includes a first side portion 64. A second side portion 66 has a first passageway 68 therethrough. A crossbar portion 70 has a second passageway 72 therethrough fluidly connected to the first passageway 68 of the second side portion 66. The crossbar portion 70 further has a plurality of longitudinal spaced apart bottom spray holes 73 fluidly connected to the second passageway 72, to allow the liquid 22 to spray out therefrom onto the first paper sheet 24.

Figures 1A, 1B, 1C, 1D, 1E:
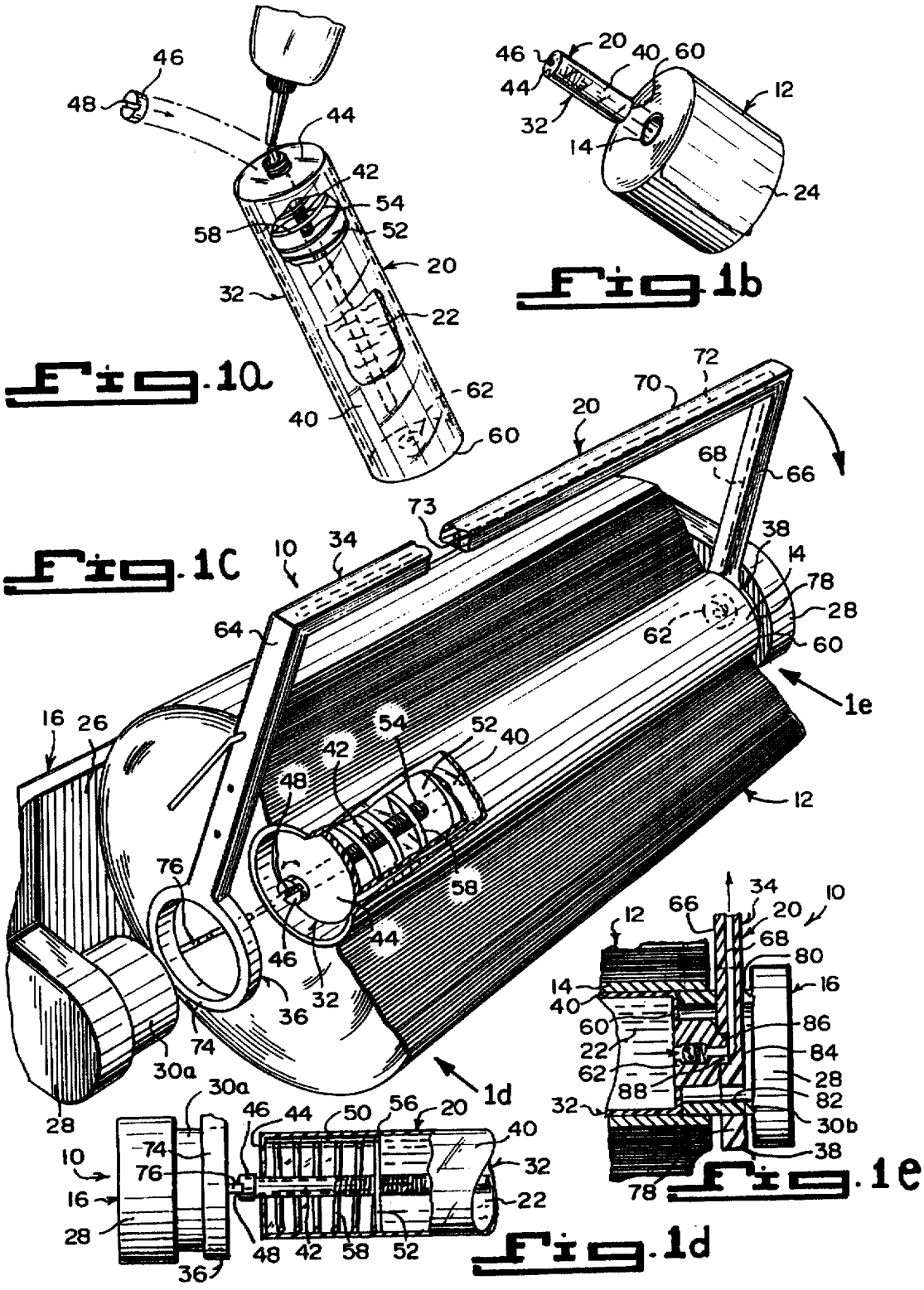

The operating facility 36, as best seen in FIGS. 1*c* and 1*d*, consists of a first ring member 74 on the first side portion 64 of the spray arm 34, to fit about the first stub shaft 30*a* of the holder 16. A blade 76 extends across the first ring member 74, to engage with the slot 48 in the cap 46 of the canister pump 32. When the spray arm 34 is pulled down, the blade 76 will turn the cap 46, which will turn the hollow threaded shaft 42, which will cause the disk plate 52 to move the follower 56 in the track 50 towards the second side 60 of the cylindrical housing 40 in the canister pump 32, forcing a predetermined amount of liquid 22 through the ball check valve 62 which will open by pressure of the liquid 22.

The fluid connecting assembly 38, as best seen in FIG. 1*c*, includes a second ring member 78 on the second side portion 66 of the spray arm 34, to fit about the second stub shaft 30*b* of the holder 16. The second stub shaft 30*b* has an annular slot 80 therethrough and a recess 82. A hollow tube 84 extends from the second ring member 78 through the annular slot 80, and the recess 82 to the ball check valve 62 on the canister pump 32. The hollow tube 84 is fluidly connected into the first passageway 68 in the second side portion 66. A socket 86 is formed at a right angle in a closed distal free end of the hollow tube 84. A plug 88 is formed on the ball check valve 62 of the canister pump 32, whereby the plug 88 fluidly engages with the socket 86. The plug 88 will carry the liquid 22 from the ball check valve 62 when opened passed the socket 86 and up the hollow tube 84 into the first passageway 68 in the second side portion 66 of the spray arm 34.

Figure 2:
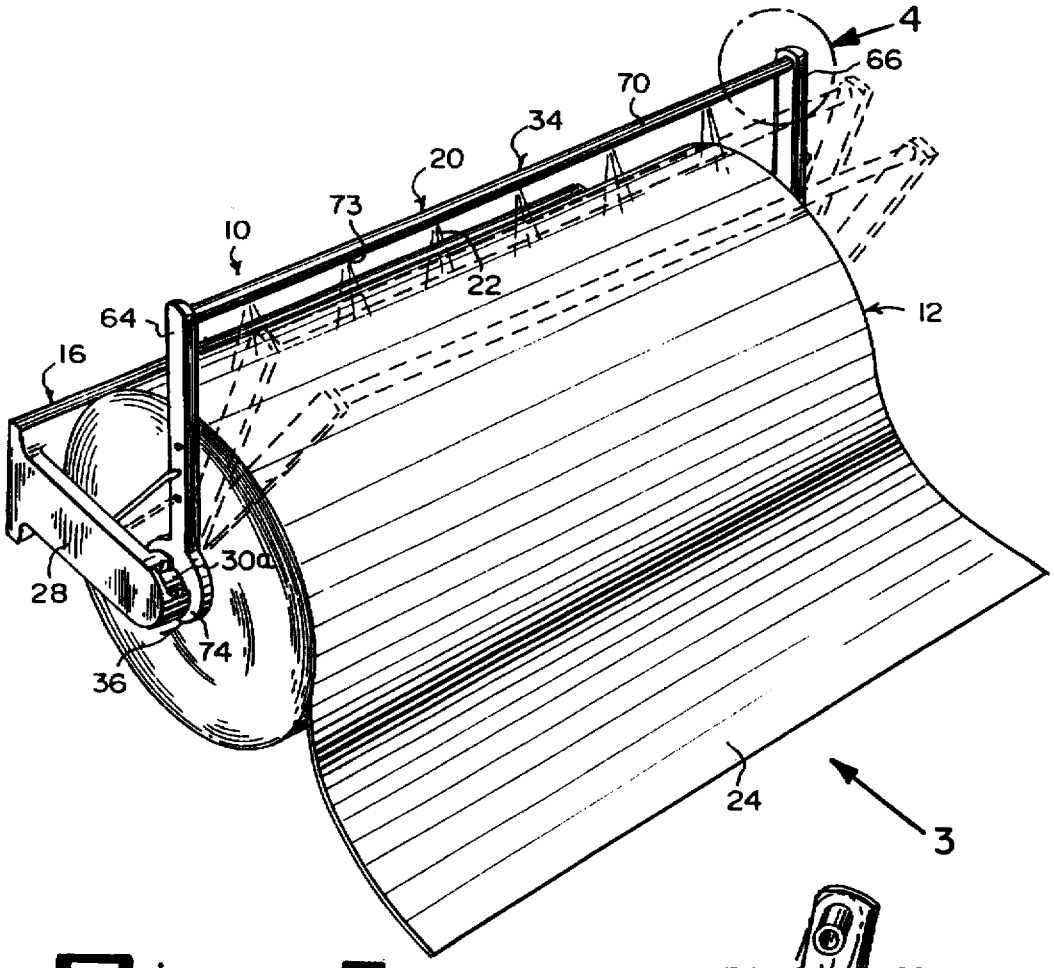
FIG. 2 is a front perspective view of a modification of the first embodiment built into a paper towel roll holder, with parts broken away.
Figure 3:
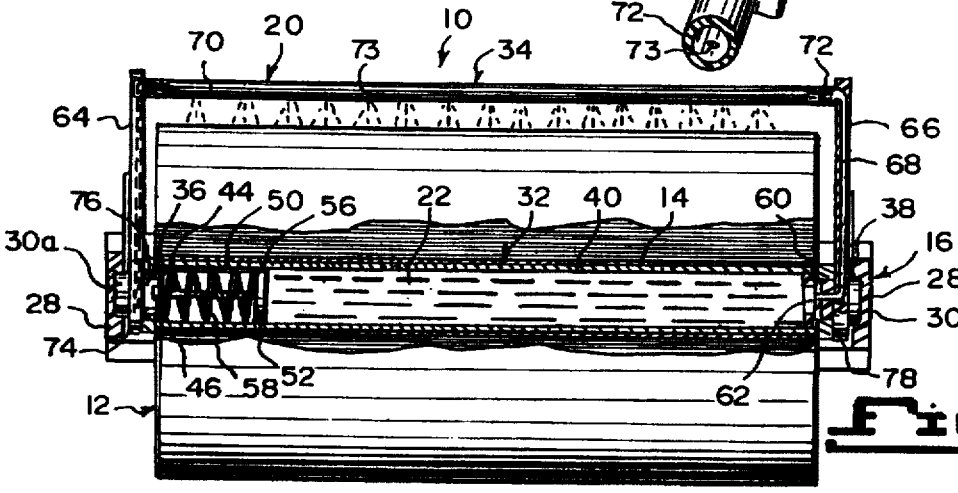
FIG. 3 is a front elevational view taken in the direction of arrow 3 in FIG. 2, with parts broken away and in section.
Figure 5:
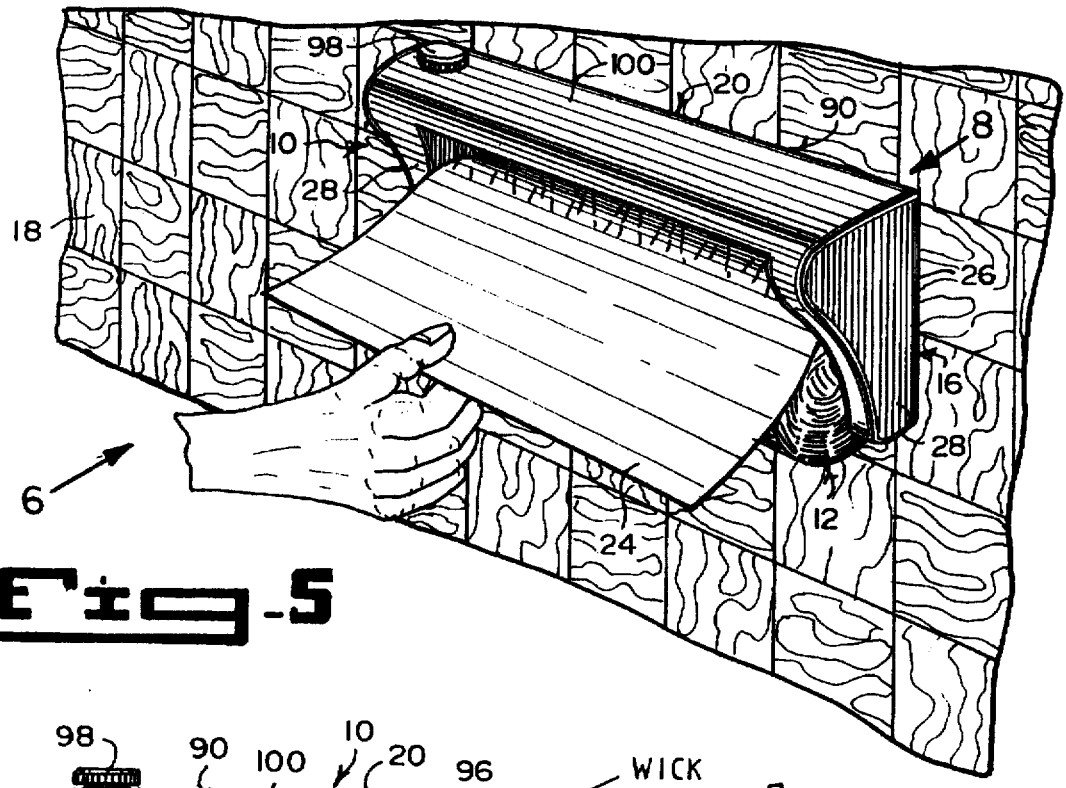
FIG. 5 is a front perspective view showing a second embodiment of the instant invention built into a paper towel roll holder mounted onto a wall.
Figure 6:
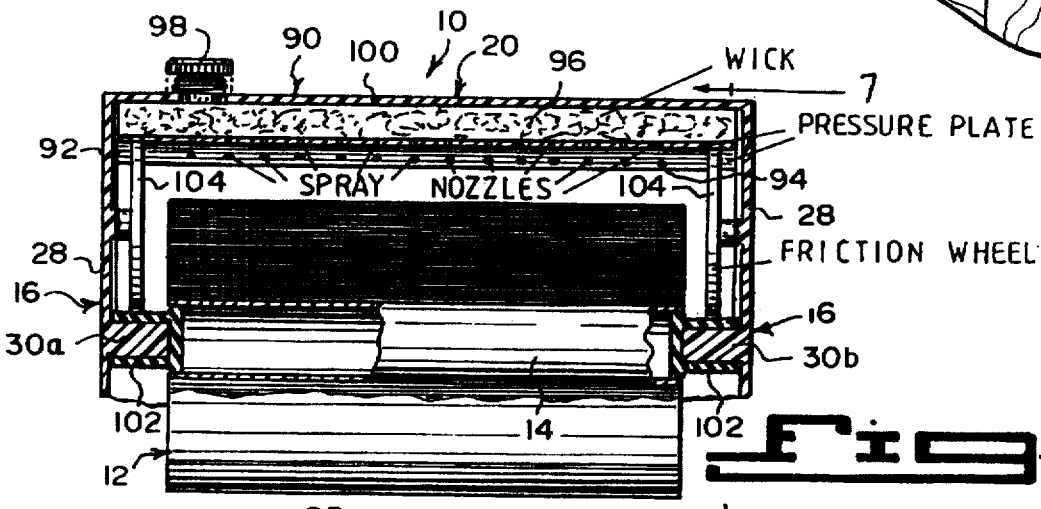
FIG. 6 is a front elevational view taken in the direction of arrow 6 in FIG. 5, with parts broken away and in section.
Figure 7:
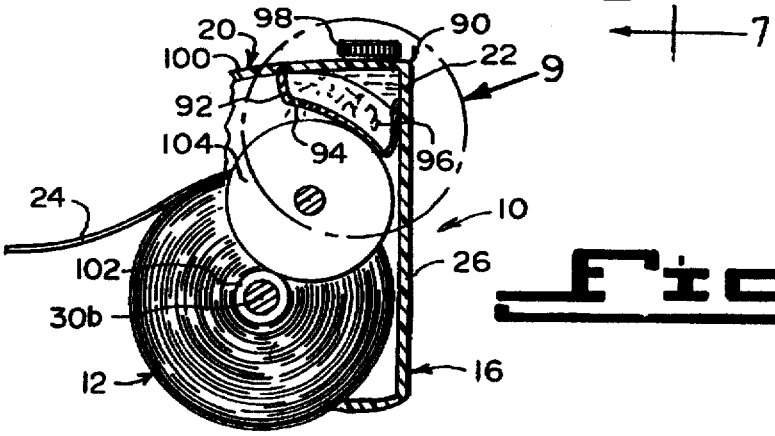
FIG. 7 is a cross sectional view taken along line 7—7 in FIG. 6.
Figure 8:
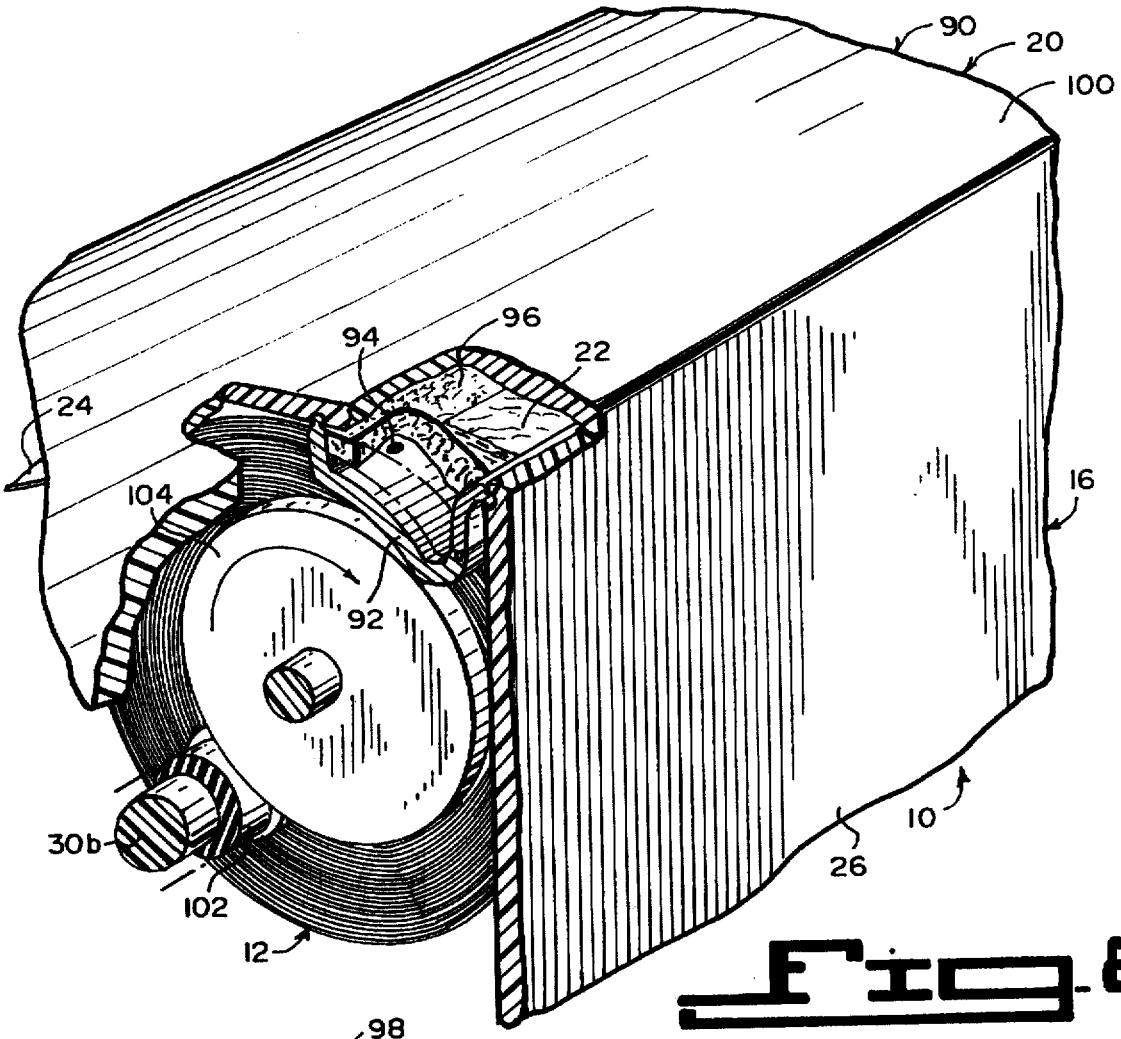
FIG. 8 is an enlarged rear perspective view taken in the direction of arrow 8 in FIG. 5, with parts broken away and in section.
Figure 9:
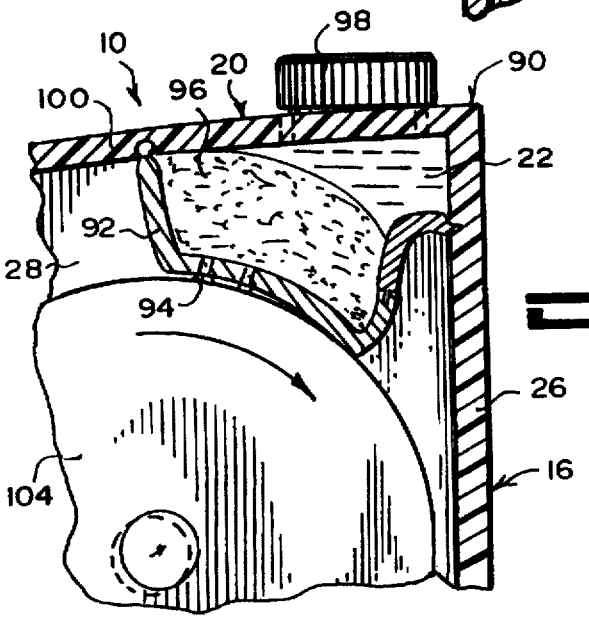
FIG. 9 is an enlarged cross sectional view as indicated by arrow 9 in FIG. 7.

In FIG. 1, the holder 16 is a recessed toilet tissue roll holder mounted in a bathroom wall 18, and the roll of paper sheets 12 is a toilet tissue roll. The holder 16 in FIGS. 1*c*, 2 and 3, is a paper towel roll holder mounted onto a wall 18 and the roll of paper sheets 12 is a paper towel roll.

Figure 4:
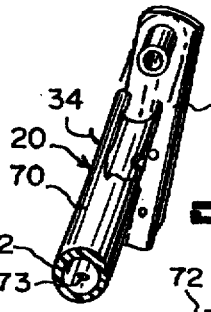
FIG. 4 is an enlarged perspective view of a portion of the movable spray arm as indicated by arrow 4 in FIG. 2.

In FIGS. 1 and 1*c*, the first side portion 64, the second side portion 68 and the crossbar portion 70 are integral and are generally square shaped in cross section. The first side portion 64, the second side portion 68 and the crossbar portion 70 in FIGS. 2, 3 and 4, are three separate pieces. The first side portion 64 and the second side portion 68 are generally square shaped in cross section, while the crossbar portion 70 is circular in cross section.

The liquid applying structure 20 in FIGS. 5 through 9, consists of a reservoir 90 longitudinally formed in the holder 16 above the roll of paper sheets 12. The reservoir 90 has a bottom curved pressure plate 92 with a series of spray nozzles 94 therealong. A wick pad 96 is carried within the reservoir 90, to hold the liquid 22 placed therein. A filler cap 98 is threaded into a top portion 100 of the reservoir 90, so as to enable the liquid 22 to be filled therein, when the filler cap 98 is removed. A pair of friction sleeves 102 are provided. Each friction sleeve 102 is mounted onto one stub shaft 30*a*, 30*b* in a rotatable manner and fits snugly into one end of the hollow core 14 of the roll of paper sheets 12.

A pair of friction wheels 104 are also provided. Each friction wheel 104 is mounted in a rotatable manner to an inner surface of one leg 28 of the holder 16. The friction wheels 104 engage with the friction sleeves 102 and the bottom curved pressure plate 92. When a person pulls the first paper sheet 24 on the roll of paper sheets 12 out, rotation of the roll of paper sheets 12 will turn the friction sleeves 102, which turns the friction wheels 104 that force the bottom curved pressure plate 92 in an upwards direction, compressing the wick pad 96, thereby causing the liquid 22 to exit out through the spray nozzles 94 onto the first paper sheet 24.

LIST OF REFERENCE NUMBERS moistening dispenser
roll of paper sheets
hollow core of 12
holder of 10
18 wall
liquid applying structure of 10
liquid
first paper sheet on 12
base member of 16
leg of 16
a stub shaft of 16
b second stub shaft of 16
canister pump of 20
generally U-shaped spray arm of 20
operating facility of 20
fluid connecting assembly of 20
cylindrical housing of 32
hollow threaded shaft of 32
first side of 40
cap of 32
slot in 46
longitudinal track in 40
disk plate of 32
internally threaded central hole in 52
follower on 52 in 50
spring of 32
second side of 40
ball check valve on 60
first side portion of 34
second side portion of 34
first passageway in 66
crossbar portion of 34
second passageway in 70
bottom spray hole in 70
first ring member of 36 on 30
blade on 74
second ring member of 38 on 30
annular slot in 30
recess in 30
hollow tube of 38
socket in 84
plug on 62
reservoir of 20
bottom curved pressure plate of 90
spray nozzle in 92
wick pad in 90
filler cap
top portion of 90
friction sleeve of 20
friction wheel It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A moistening dispenser for a roll of paper sheets having a hollow core, said dispenser comprising:

a) a holder to be attached to a wall, said holder having means for retaining the hollow core of the roll of paper sheets in a rotatable manner, said retaining means comprising a base member attached to a wall, a pair of spaced legs projecting out from said base member, and a pair of stub shafts, each stub shaft projecting sidewards at a right angle from one side of a leg and parallel to said base member and facing each other to engage the opposite ends of and for supporting the hollow core of the roll of paper sheets;

b) means built into the retaining means of said holder for applying a predetermined amount of liquid directly onto a paper sheet on the roll just before the paper sheet is removed from the roll; and c) said liquid applying means comprising a canister pump for holding the liquid removably positioned within the hollow core of said roll of paper sheets, means for spraying said sheet of paper comprising a generally U-Shaped spray arm with first and second side portions and a crossbar portion connecting a first end of each side portion spaced from and spanning said roll of paper with said first and second side portions pivotally mounted in an inverted manner onto said stub shafts, means at the second end of said first side portion of said spray arm for operating said canister pump when said spray arm is pulled down, and means at the second end of said second side portion of said spray arm fluidly connected to said canister pump for receiving liquid from said canister pump when said spray arm is pulled down, said crossbar portion and second side portion of said spray arm having interconnected passageways with said crossbar having a plurality of spaced spray holes facing said roll of paper for spraying said paper when said spray arm is pulled down.

2. A moistening dispenser as recited in claim 1, wherein said canister pump includes:

a) a sealed cylindrical housing sized to fit snugly into the hollow core of the roll of paper sheets;

b) a hollow threaded shaft having a first end extending outward from a first side of said cylindrical housing and a second end extending into said cylindrical housing, so that the liquid can be filled into said cylindrical housing;

c) a cap having a slot, threads onto the first end of said hollow threaded shaft;

d) a longitudinal track on an interior surface of said cylindrical housing;

e) a disk plate having an internally threaded central hole, threads onto said hollow threaded shaft within said cylindrical housing;

f) a follower on said disk plate, rides within said longitudinal track;

g) a spring within said cylindrical housing between the first side of said cylindrical housing and said disk plate, so as to bias said disk plate towards a second side of said cylindrical housing that is holding the liquid therein; and h) a ball check valve on the second side of said cylindrical housing.

3. A moistening dispenser as recited in claim 2, wherein said operating means includes:

a) a first ring member on said first side portion of said spray arm to fit about said first stub shaft of said holder; and b) a blade extending across said first ring member to engage with said slot in said cap of said canister pump, so that when said spray arm is pulled down, said blade will turn said cap, which will turn said hollow threaded shaft, which will cause said disk plate to move said follower in said track towards the second side of said cylindrical housing in said canister pump, forcing a predetermined amount of liquid through said ball check valve which will open by pressure of the liquid.

4. A moistening dispenser as recited in claim 3, wherein said fluid connecting means includes:

a) a second ring member on said second side portion of said spray arm, to fit about said second stub shaft of said holder;

b) said second stub shaft having an annular slot therethrough and a recess;

c) a hollow tube extending from said second ring member through said annular slot and said recess to said ball check valve on said canister pump, said hollow tube fluidly connected into the first passageway in said second side portion;

d) a socket formed at a right angle in a closed distal free end of said hollow tube; and e) a plug formed on said ball check valve of said canister pump, whereby said plug fluidly engages with said socket, so that said plug will carry the liquid from said ball check valve when opened passed said socket and up said hollow tube into the first passageway in said second side portion of said spray arm.

5. A moistening dispenser as recited in claim 2, wherein said first side portion, said second side portion and said crossbar portion are integral and are generally square shaped in cross section.

6. A moistening dispenser as recited in claim 2, wherein said first side portion, said second side portion and said crossbar portion are three separate pieces, in which said first side portion and said second side portion are generally square shaped in cross section, while said crossbar portion is circular in cross section.

7. A moistening dispenser as recited in claim 1, wherein said holder is a recessed toilet tissue roll holder mounted in a bathroom wall and the roll of paper sheets is a toilet tissue roll.

8. A moistening dispenser as recited in claim 1, wherein said holder is a paper towel roll holder mounted onto a wall and the roll of paper sheets is a paper towel roll.

9. A moistening dispenser for a roll of paper sheets having a hollow core, said dispenser comprising:

a) a holder having means for retaining the hollow core of the roll of paper sheets in a rotatable manner, said retaining means comprising a base member attached to a wall, a pair of spaced legs projecting out from said base member, and a pair of stub shafts, each stub shaft projecting sidewards at a right angle from one side of a leg and parallel to said base member and facing each other to engage the opposite ends of and for supporting the hollow core of the roll of paper sheets;

b) means built into the retaining means of said holder for applying a predetermined amount of liquid directly onto a paper sheet on the roll as and in response to said paper sheet being removed from the roll; and c) said liquid applying means comprising a reservoir longitudinally formed in said holder above the roll of paper sheets, said reservoir having a bottom curved pressure plate with a series of spray nozzles therealong, a wick pad carried within said reservoir to hold the liquid placed therein, a filler cap threaded into a top portion of said reservoir, to enable the liquid to be filled therein when said filler cap is removed, a pair of friction sleeves, each said friction sleeve mounted onto one said stub shaft in a rotatable manner and fitting snugly into one end of the hollow core of the roll of paper sheets, and a pair of friction wheels, each said friction wheel mounted in a rotatable manner on an inner surface of one said leg of said holder, said friction wheels engaging said friction sleeves and said bottom curved pressure plate, so that when a person pulls out a paper sheet on the roll of paper sheets, rotation of the roll of paper sheets will turn said friction sleeves, which turn said friction wheels that force said bottom curved pressure plate in an upwards direction, compressing said wick pad, thereby causing the liquid to exit out through said spray nozzles onto said paper sheet.

* * * * *